US006422389B1

(12) United States Patent
Ritola et al.

(10) Patent No.: US 6,422,389 B1
(45) Date of Patent: Jul. 23, 2002

(54) KIT PACKAGE ADAPTED FOR DISPLAY OF SELECT KIT COMPONENTS

(75) Inventors: Roy Ritola, Mill Valley, CA (US); Ernie Petit, Rockford; Wayne Fletcher, Loves Park, both of IL (US)

(73) Assignee: The Testor Corporation, Rockford, IL (US)

( * ) Notice: Subject to any disclaimer, the term of this patent is extended or adjusted under 35 U.S.C. 154(b) by 0 days.

(21) Appl. No.: 09/690,668

(22) Filed: Oct. 17, 2000

Related U.S. Application Data

(60) Provisional application No. 60/160,342, filed on Oct. 19, 1999.

(51) Int. Cl.[7] ..... B65D 73/00

(52) U.S. Cl. ..... 206/486; 206/747; 206/763; 206/765

(58) Field of Search ..... 206/745, 747, 206/756, 757, 759, 762, 763, 764, 765, 766, 45.24, 769, 223, 581, 216

(56) References Cited

U.S. PATENT DOCUMENTS

| | | | | | |
|---|---|---|---|---|---|
| 2,464,951 | A | * | 3/1949 | Stengren | 206/223 |
| 3,057,466 | A | * | 10/1962 | Blonder | 206/223 |
| 3,167,179 | A | * | 1/1965 | Goldstein | 206/766 |
| 3,533,503 | A | * | 10/1970 | Wood | 206/769 |
| D223,681 | S | * | 5/1972 | Whitaker | 206/561 |
| 3,708,061 | A | * | 1/1973 | Weingarden | 206/216 |
| 3,835,987 | A | * | 9/1974 | Growney | 206/457 |
| 4,185,739 | A | * | 1/1980 | Wilford | 206/335 |
| 4,219,035 | A | * | 8/1980 | Deconinck | 206/581 |
| 4,732,274 | A | * | 3/1988 | Bouton | 206/561 |
| 4,750,619 | A | * | 6/1988 | Cohen et al. | 206/438 |
| 5,289,916 | A | * | 3/1994 | Mickelberg | 206/45.34 |
| 6,102,233 | A | * | 8/2000 | Waugh | 220/23.86 |

* cited by examiner

*Primary Examiner*—Shian Luong
(74) *Attorney, Agent, or Firm*—Fay, Sharpe, Fagan, Minnich & McKee, LLP

(57) ABSTRACT

A kit package includes an inner package element that defines a pedestal base having a support surface adapted for supporting an associated primary kit component. The pedestal base also defines a region adapted for receipt of an associated secondary kit component. A secondary component securement flaps are connected to the pedestal base and is movable into a folded position adjacent the pedestal base. The flap at least partially encloses the secondary component receiving region. An outer package element defines a hollow compartment adapted for receipt of the inner package element. A distal end of the flap projects outwardly beyond the pedestal support surface when the flap is located in its folded position. The flap distal defines a recess adapted for close receipt of a portion of an associated primary kit component. The pedestal base defines a hollow region that is adapted to receive one or more packages of loose kit components.

15 Claims, 6 Drawing Sheets

KIT PACKAGE ADAPTED FOR DISPLAY OF SELECT KIT COMPONENTS

CROSS-REFERENCE TO RELATED APPLICATION

This application claims priority from and hereby expressly incorporates by reference U.S. provisional application No. 60/160,342 filed Oct. 19, 1999.

BACKGROUND OF THE INVENTION

The present invention relates generally to packaging. More particularly, the invention is directed to a new and improved package for a kit of components to be assembled into a finished article, wherein the package is adapted to display prominently at least primary and secondary decorative components of the kit for viewing by potential purchasers.

The subject invention finds particular application and will be explained in connection with packaging kits of "model" components, i.e., components to be assembled into a model of an automobile, an airplane, boat, or the like. Of course, those of ordinary skill in the art will recognize that a package formed in accordance with the present invention has wider applications, and it is not intended that the invention be limited to packaging of any particular type of kit components.

Kits of components to be assembled into model automobiles, boats, planes, and the like have traditionally been packaged in simple cardboard boxes that are sealed to prevent loss of components and thus prevent examination of the components prior to making a purchase. These boxes have included illustrations of the finished model (or the actual item to be represented by the completed model) on exterior faces for viewing by potential purchasers. However, with these conventional packages, again, a user has been unable to view any of the actual model components. Therefore, there is an increased potential that a customer will not purchase the kit or might be dissatisfied once the kit is purchased and then opened. Furthermore, in certain instances, components placed in these prior boxes have been subject to damage.

Other packaging for model kits has been found to be deficient for a variety of reasons. As noted, some have not securely retained and protected the kit components during shipping and handling. Others, have not been specifically adapted for prominently displaying primary and secondary decorative kit components in a prominent and aesthetically pleasing manner so as to encourage a potential purchaser to purchase the kit. Still other package constructions have been found to be unduly expensive due to the materials used and/or the complexity of construction.

In light of the foregoing specifically noted deficiencies and others associated with prior package designs for model kit components, a need has been found for a new and improved kit package adapted for display of select kit components, such as primary and secondary decorative kit components, in a prominent, secure, and aesthetically pleasing manner, without the package being overly complex or expensive.

SUMMARY OF THE INVENTION

In accordance with the present invention, a novel and unobvious kit package adapted for displaying select kit components is advantageously provided.

In accordance with another aspect of the present invention, a novel and unobvious method of packaging a kit is provided.

In accordance with still another aspect of the present invention, a novel and unobvious kit is provided.

According to the invention, the kit package includes inner and outer package elements, each preferably defined from transparent, semi-rigid molded/formed plastic. The inner package element defines a base in the form of a pedestal that includes a horizontally extending support surface and a plurality of side walls that depend from the support surface. A hollow region, adapted for receiving loose kit components, is defined beneath the support surface and between the depending side walls. The hollow region is adapted for receiving one or more packages of loose kit components that are retained therein by tape or other suitable and convenient means.

The pedestal support surface is adapted for supporting one or more primary or major decorative kit components, e.g., a vehicle body. The support surface preferably defines a plurality of apertures usable with tie-down straps or other securing means for retaining the primary kit component(s) to the support surface. Two of the pedestal side walls, preferably end walls located at opposite ends of the base, define one or more secondary decorative component display wells or regions in their outer faces. These regions are adapted for receiving secondary decorative kit components that are smaller or otherwise less significant than the primary decorative kit component supported on the support surface.

A secondary component securement flap is connected to and extends outwardly from a lowermost edge of each end wall. These flaps are connected to the end walls by living hinges so that they are pivotable upwardly and inwardly into a folded position where they lie adjacent their respective end walls. The flaps are defined so that when they are pivoted to lie adjacent their respective end walls, they at least partially enclose and/or further define the secondary component display wells defined in the end wall outer faces and capture the secondary decorative components therein. Preferably, the flaps extend upwardly above the pedestal support surface and offer protection to the primary kit component.

The outer package element defines a hollow compartment adapted for receipt of the base when the flaps are placed in their folded position. In a first embodiment, a lid is selectively secured to the outer package component in covering relation with the hollow compartment to seal the base therein. Product literature or the like may be conveniently placed beneath the lid or between the base and the outer package component. In an alternative embodiment, the outer package comprises two outer package members that each define a recess. When these two outer package members are connected, they together define a hollow compartment adapted for receipt of the inner package element.

One advantage of the present invention resides in the provision of a new and improved kit package for full display of selected kit components.

Another advantage of the invention is found in the provision of an aesthetically pleasing kit package that is economical to manufacture.

A further advantage of the invention is the provision of a kit package wherein a primary decorative kit component is prominently displayed for inspection by potential purchasers.

Still another advantage of the present invention resides in the provision of a kit package wherein one or more secondary decorative kit components may be conveniently displayed, together with an associated primary decorative kit component, to potential purchasers.

Still other benefits and advantages of the present invention will become apparent to those of ordinary skill in the art upon reading and understanding the following specification.

BRIEF DESCRIPTION OF THE DRAWINGS

The invention comprises various components and arrangements of components, and various steps and arrangements of steps, preferred embodiments of which are illustrated in the accompanying drawings that form a part hereof and wherein.

DETAILED DESCRIPTION OF PREFERRED EMBODIMENTS

Figure 1:
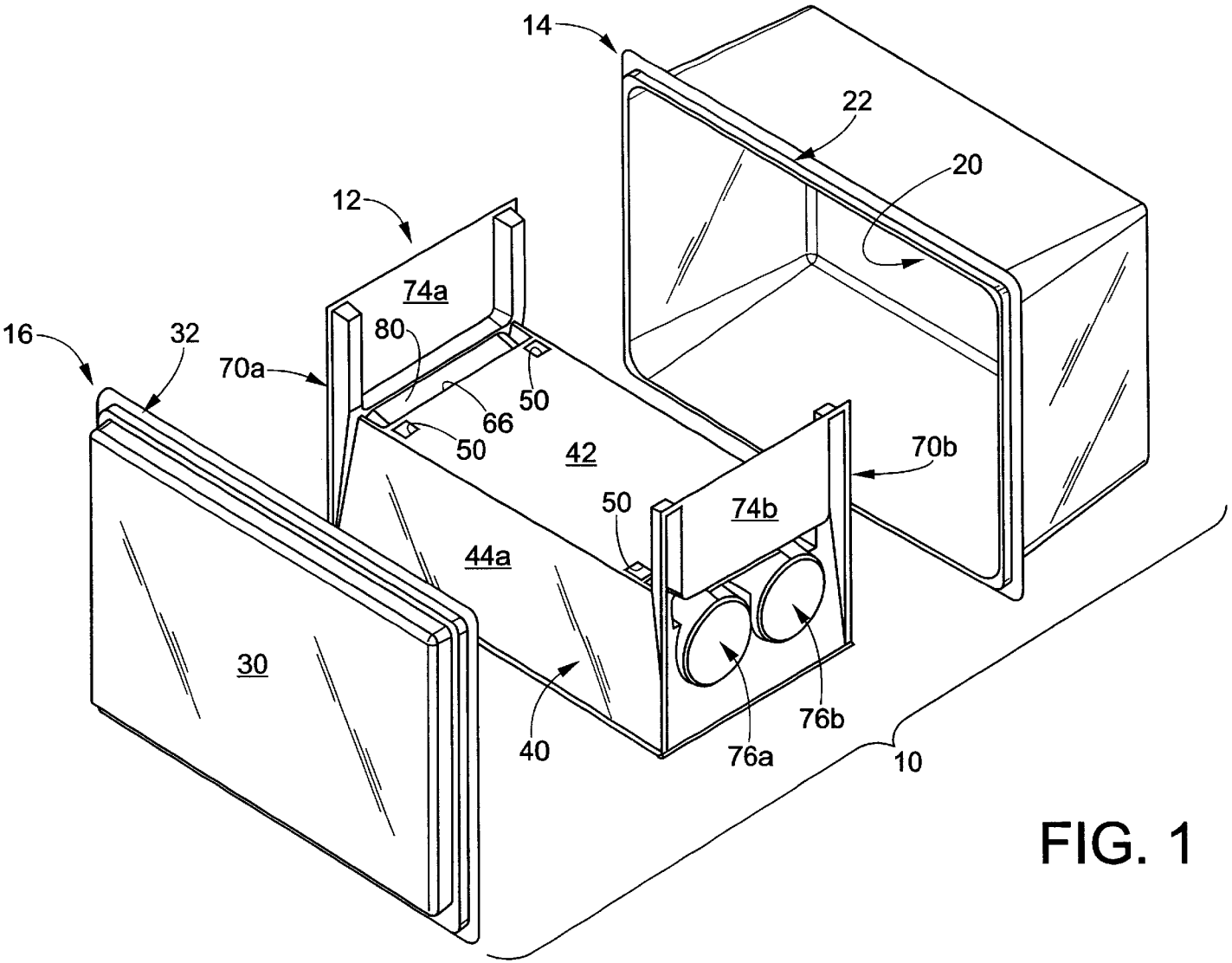
FIG. 1 is an exploded perspective view of a kit package formed in accordance with the present invention.

Referring now to the drawings wherein the showings are for purposes of illustrating a preferred embodiment of the invention only and not for purposes of limiting same, FIG. 1 shows a package 10 formed to include an inner package element 12, an outer package element 14, and a lid 16. In general, the package 10 is adapted for retaining or housing components of an associated kit, e.g., a kit of components to be assembled in a model car, truck, airplane, or the like. More particularly, the inner package element 12 is adapted for holding the kit components while the outer package element 14 and lid 16, are together adapted to enclose or encase the inner package element and kit components held thereby.

The outer package element 14 is preferably constructed from transparent, semi-rigid molded or formed plastic as a one-piece construction. This element defines a deep, hollow recess or compartment 20 that is adapted for receiving the inner package element 12. The outer package element 14 also defines a peripheral flange or lip 22 of the recess 20.

The lid 16, also preferably comprised of molded/formed transparent plastic, is adapted for selective connection to the outer package element 14 in covering relation with the recess 20 to seal the inner package element 12 and associated kit components in the recess 20. More particularly, the lid 16 comprises a generally planar member 30 having a peripheral lip 32 adapted to mate with the peripheral lip 22 of the outer package element 14 by way of a close friction-fit. Thus, the lid 16 may be selectively removed and connected to the outer package element 14.

Figure 2:
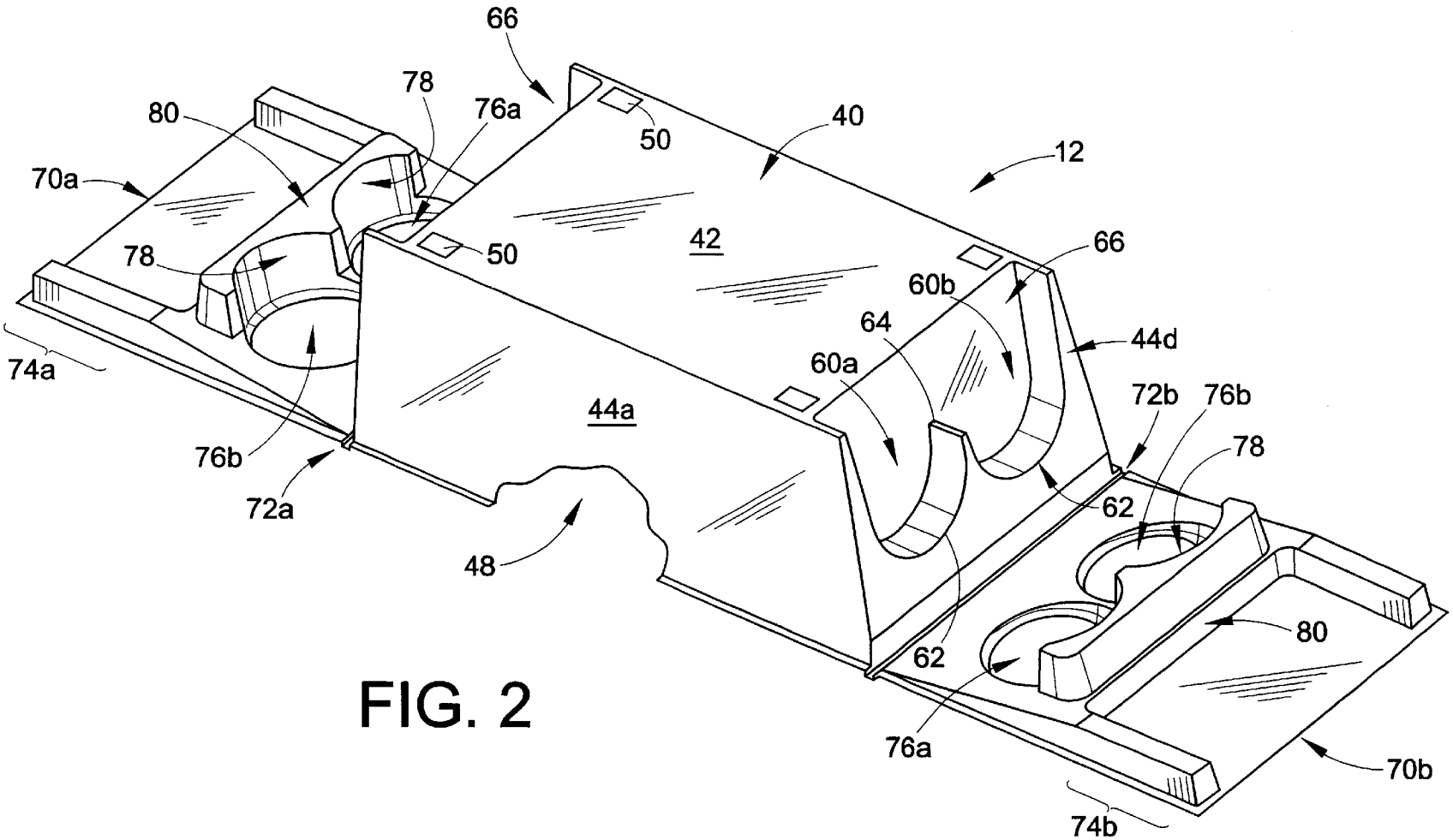
FIG. 2 is a perspective view, partially broken away, illustrating an inner package element formed in accordance with the invention.
Figure 3:
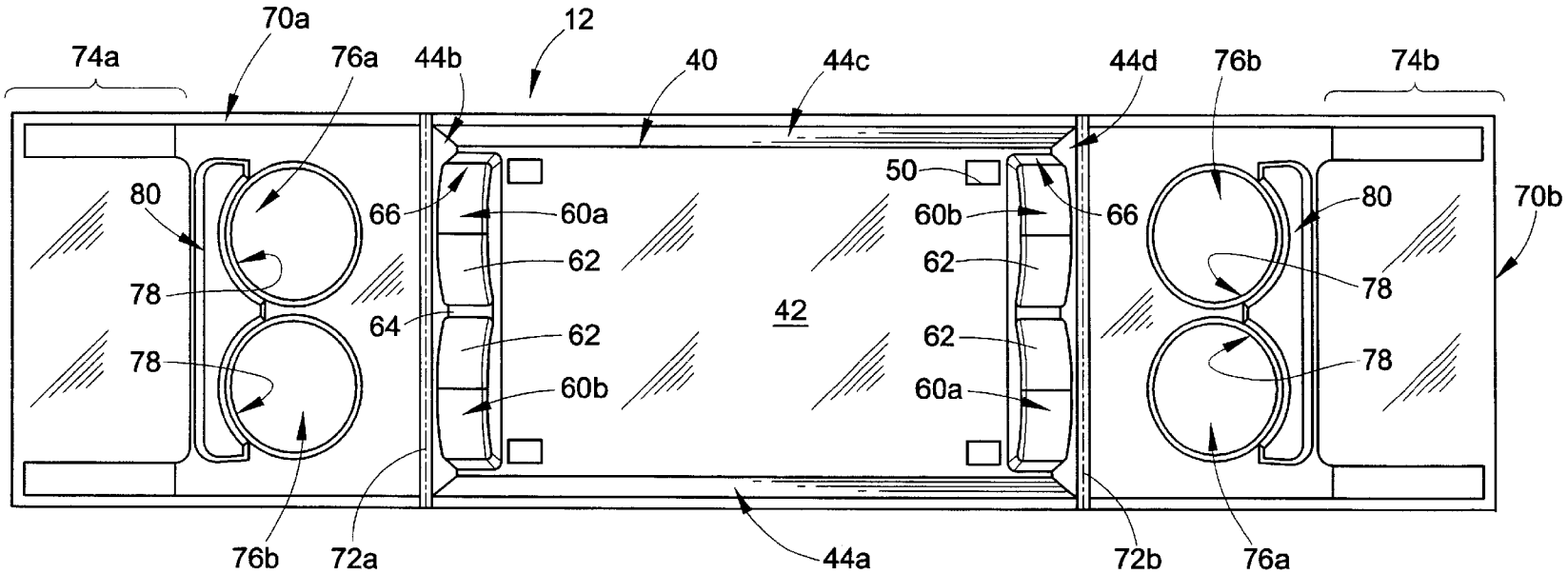
FIG. 3 is a top plan view of the inner package element illustrated in FIG. 2.

With reference now also to FIGS. 2 and 3, the inner package element 12 is also preferably constructed from transparent, semi-rigid molded or formed plastic as a one-piece construction. The inner component comprises a base member 40 defined as a pedestal. The pedestal base 40 is defined by a horizontally extending, planar support surface 42 and peripheral side walls 44*a*–44*d* depending from the surface 42. Thus, a hollow region 48 (FIG. 2) is defined beneath the support surface 42 and between the side walls 44*a*–44*d*. This hollow region 48 is adapted to receive kit components that have been placed in one or more bags or like packaging. These packaged kit components can be fixedly secured in the hollow region 48 using tape or other suitable or convenient means.

The support surface 42 of the base 40 is adapted for supporting a primary decorative kit component thereon in a prominent manner. The primary kit component preferably comprises the main and/or largest decorative kit component such as, e.g., a vehicle body of a car when the associated kit components housed in the package 10 relate to a vehicle model. A plurality of apertures 50 are conveniently defined in the base 40, preferably through the surface 42, and tie-down straps or the like (not shown) can be passed through these apertures 50 to fixedly secure the associated primary decorative kit component on the support surface 42.

At least one of the sidewalls 44*a*–44*d*, and preferably two located on opposite ends of the base 40, i.e., end walls 44*b*,44*a*, includes or defines at least one secondary decorative component receiving region in an outer face thereof. This region is adapted to receive and retain a secondary decorative kit component. As illustrated herein, the end walls 44*b*,44*d* each define first and second component receiving regions 60*a*,60*b*. Regions 60*a*,60*b* are each at least partially defined by a cylindrical surface 62 and are separated by a cusp 64. Together, regions 60*a*,60*b* define a recess 66 in the end walls 44*b*,44*d*.

The secondary component receiving regions 60*a*,60*b* are specifically adapted for receiving decorative wheel and tire assembly components of a vehicle model kit to prominently display same for viewing by a potential purchaser of the kit. Of course, the secondary kit component receiving regions may take any of a wide variety of other forms as necessary or desired to receive and retain other decorative components of kit. It is not intended that the present invention be limited to the particular configuration illustrated herein for the secondary decorative component receiving regions. Other conformations for these regions may be used without departing in any way from the overall scope and intent of the present invention.

To ensure that the secondary decorative kit components held by the secondary component receiving regions 60*a*,60*b* are securely retained therein during shipping and handling of the package 10, the inner package element 12 further includes first and second end flaps 70*a*,70*b* hingedly connected to the end walls 44*b*,44*d* respectively. Preferably, the flaps 70*a*,70*b* are secured to their respective end walls 44*b*,44*d* through use of living hinges 72*a*,72*b* so that the entire inner package element 12, including the base 40 and the end flaps 70*a*,70*b*, can be molded or otherwise formed as a one-piece construction. Flaps 70*a*,70*b* are preferably identical and are adapted for pivoting movement between an extended position (FIGS. 2, 3), where they are spaced from the end walls 44*b*,44*d*, and a folded position (FIG. 1), where they lie adjacent the end walls.

Each flap, 70*a*,70*b* defines a distal or outermost portion 74*a*,74*b*, respectively, adapted to extend upwardly or outwardly beyond the pedestal support surface 42 when the flaps are in the folded position as illustrated in FIG. 1. These upwardly extending distal portions 74*a*,74*b* offer additional protection to a primary decorative kit component supported on the surface 42 during shipping and handling.

The portion of each flap 70*a*,70*b* that interconnects the outermost portion 74*a*,74*b* to the base 40 is configured to compliment the secondary component receiving regions 60*a*,60*b* in the end walls 44*b*,44*d*. This arrangement further defines the receiving regions and captures any associated secondary decorative components. Thus, to compliment the regions 60*a*,60*b*, each flap 70*a*,70*b* defines regions 76*a*,76*b* that each comprising a cylindrical surface 78. When the flaps 70*a*,70*b* are placed in their folded position adjacent the end walls 44*b*,44*d*, the cylindrical surfaces 62 of each region 60*a*,60*b* and the cylindrical surface 78 of each region 76*a*,76*b* are arranged in opposed facing relation. As such, they cooperate to at least substantially encircle the secondary decorative components, e.g., wheel/tire assemblies, in the regions 60*a*,60*b*. The flaps 70*a*,70*b* thus prevent undesired movement of secondary decorative components out of the regions 60*a*,60*b* during shipping and handling.

Each flap 70*a*,70*b* also defines a protrusion 80 adapted for close, sliding receipt in the recess 66 defined in the end walls 44*b*,44*d* when the flaps 70*a*,70*b* are in their folded positions. This relationship ensures proper alignment of the flaps 70*a*,70*b* with their respective end walls 44*b*,44*d* and prevents lateral sliding movement between same.

If desired, printed matter or indicia (not shown) for providing information to a potential purchaser can be placed in the outer package element 14, intermediate inner and outer elements 12,14 or beneath the lid 16. Also, while it is most preferred that both the inner and outer elements be constructed from uncolored, transparent or substantially transparent plastic, they may alternatively be colored and/or opaque if desired for aesthetic purposes or to conceal the contents of the outer package element 14 and/or the hollow region 48.

Figure 4:
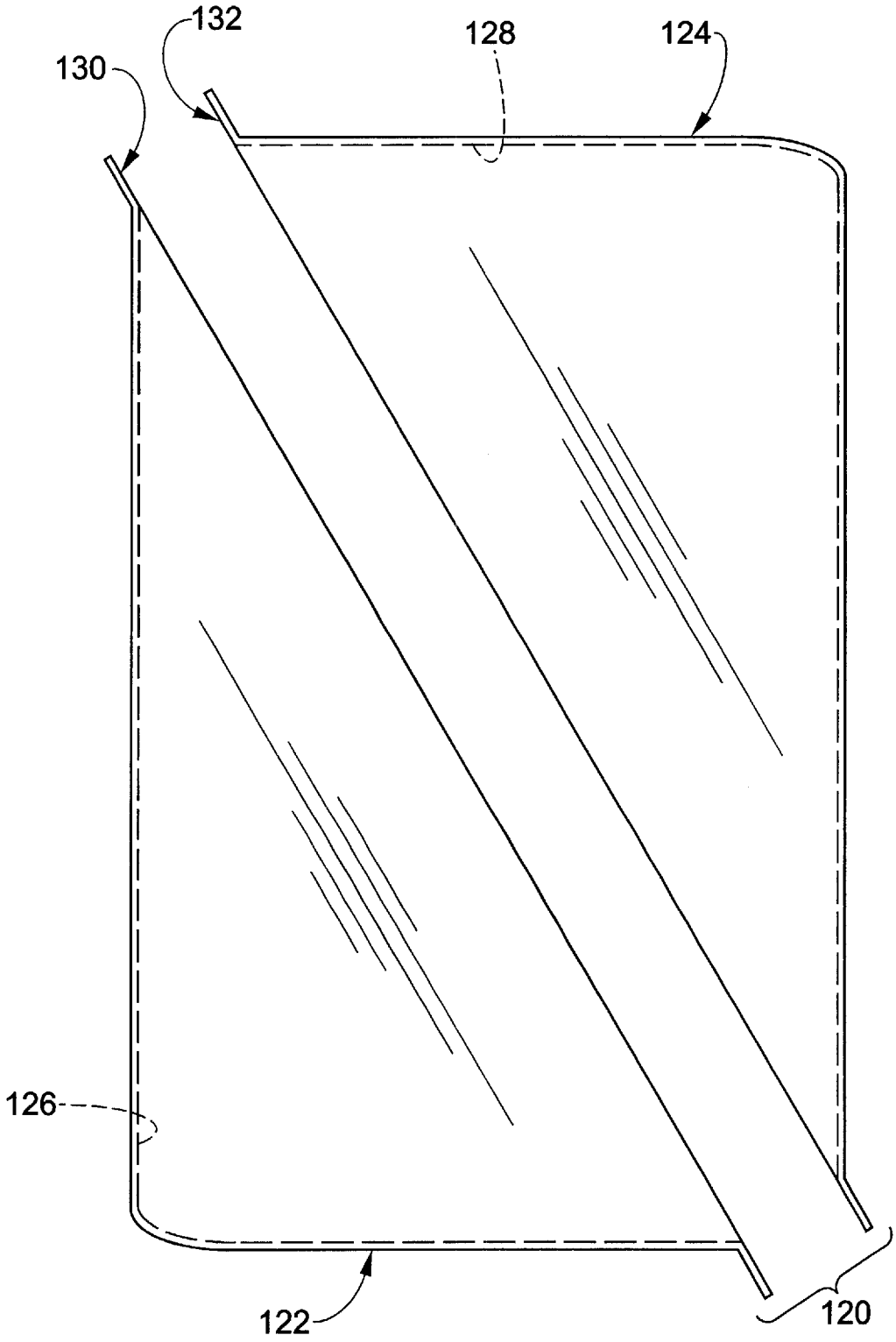
FIG. 4 is an exploded side elevational view of an alternative outer package element formed in accordance with the present invention.

FIG. 4 illustrates an outer package element 120 formed in accordance with an alternative embodiment of the present invention. The outer package element comprises first and second portions 122,124 that define respective hollow recesses 126,128. Each portion 122,124 is preferably defined from a transparent plastic material. The first and second portions define respective peripheral flanges 130,132 that are adapted for mating and fixed securement to each other. With the flanges 130,132 mated and secured together, the hollow recesses 126,128 are arranged in opposed facing relation and together define a hollow interior compartment adapted for receipt of the inner package element 12 and associated kit components.

Figure 5:
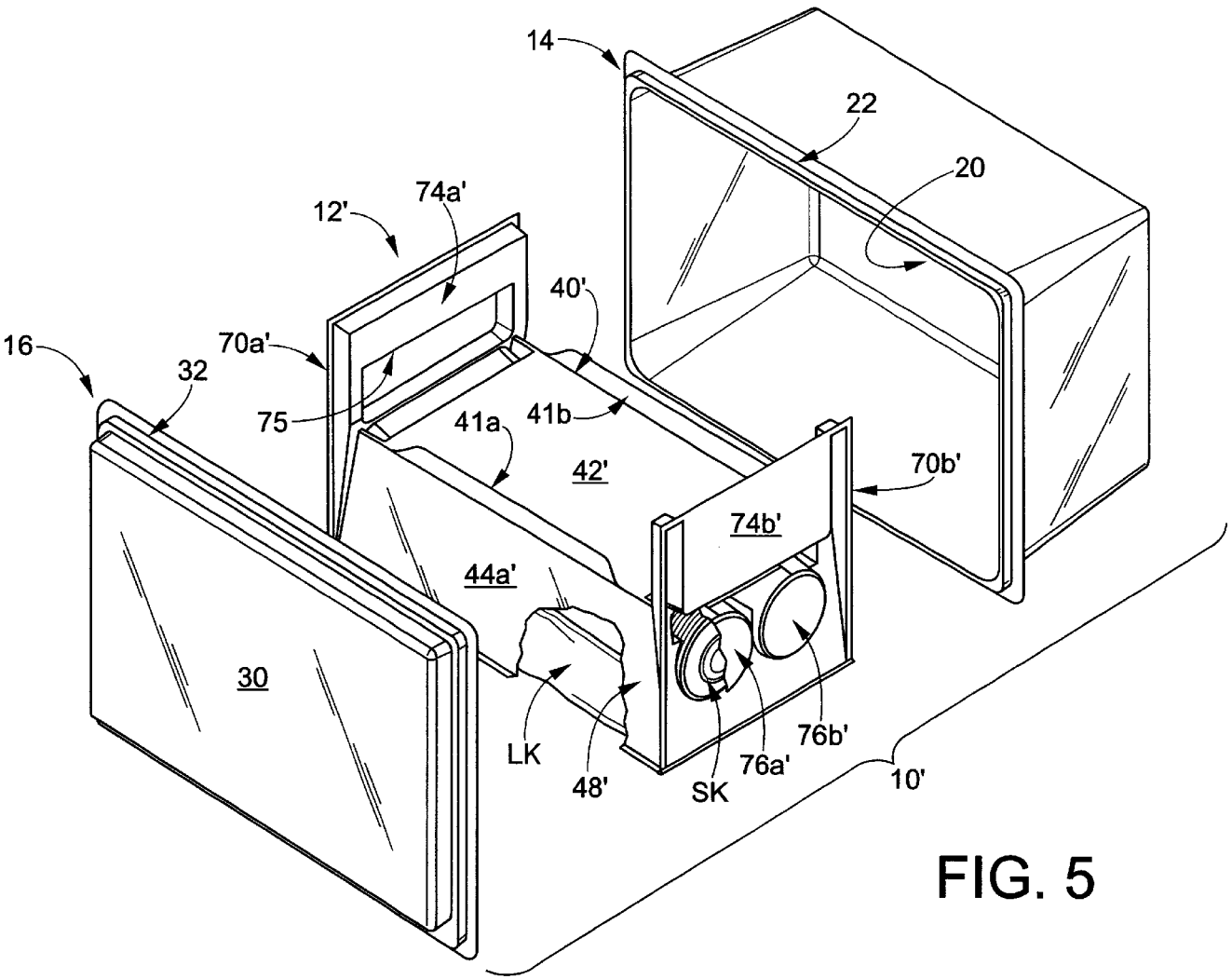
FIG. 5 is an exploded perspective view of a kit package formed in accordance with an alternative embodiment of the present invention with portions broken away; and, FIG. 6 is a partial side elevational view of the inner package element of the kit package shown in FIG. 5.
Figure 6:
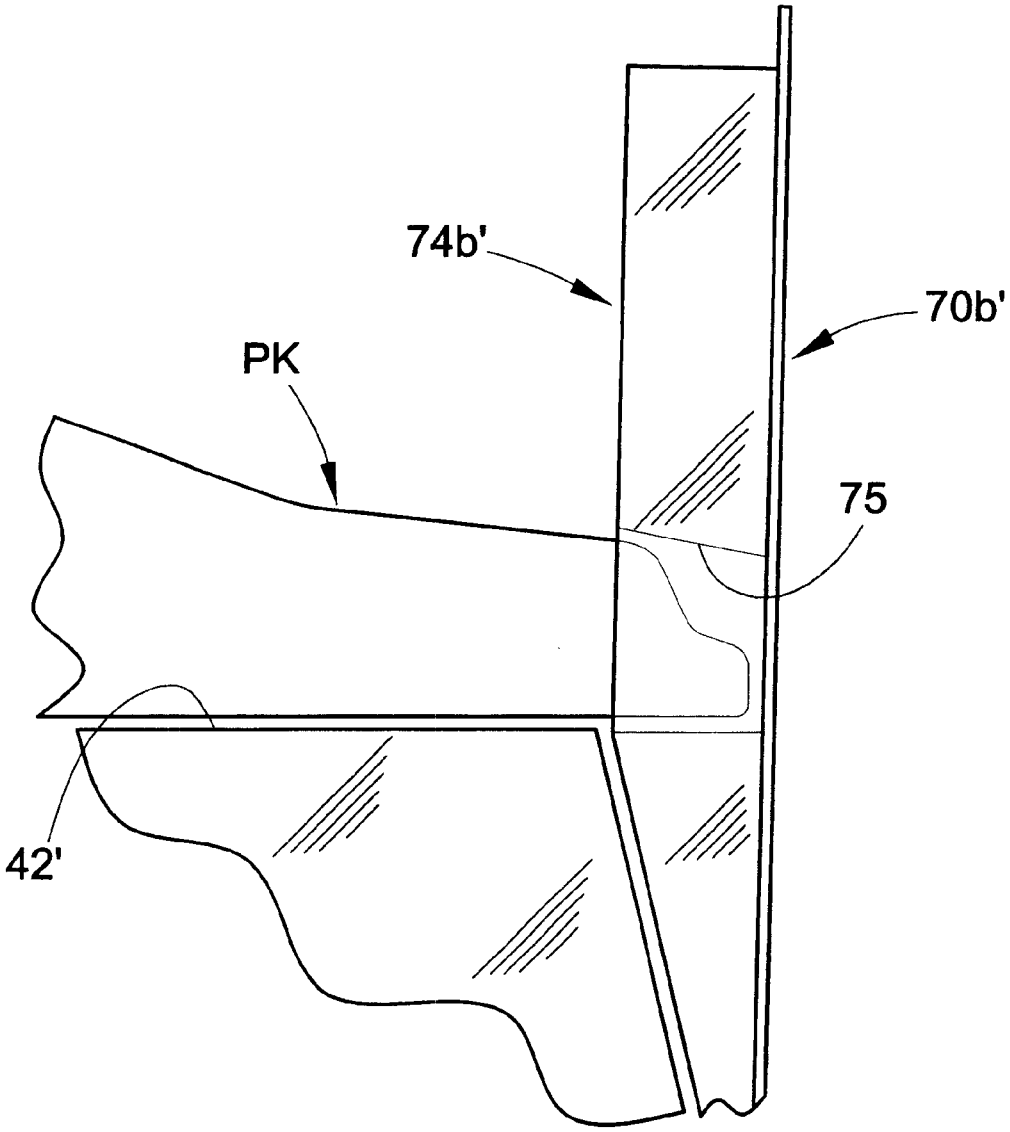

Turning now to FIGS. 5 and 6, an alternative kit package 10' is illustrated along with a primary kit component PK (e.g., a vehicle body as shown in FIG. 6), a secondary kit component SK (e.g., a vehicle wheel/tire assembly as shown in FIG. 5), and a package of loose kit components LK. Except as otherwise shown and described, the kit package 10' is identical to the kit package 10. In particular, the outer package element 14 and lid 30 are identical to those described in relation to FIG. 1. The inner package element 12' is similar to the inner package element 12 and, thus, like components relative to the inner package element 12 are identified with like reference numerals including a primed (') suffix.

More particularly, the inner package element 12' includes a pedestal base 40' defining a support surface 42'. First and second ridges 41*a*,41*b* project outwardly away from the surface 42' on opposite sides thereof. An associated primary kit component PK supported on the surface 42' is preferably positioned between these two ridges.

In addition, the flaps 70*a*',70*b*' each define a recesses 75 (only one visible in FIG. 5) that opens in a direction toward the other flap and that is adapted for close sliding receipt of a portion of a primary kit component PK supported on the surface 42' when the flaps 70*a*',70*b*' are placed in their folded positions. This is illustrated in FIG. 6 wherein an end portion of the primary kit component PK is closely received in the recess 75 of the flap 70*b*'. Those of ordinary skill in the art will recognize that, with portions of the primary kit component held in the recesses 75, the primary kit component is effectively prevented from movement away from the support surface 42' without use of tie-downs, tape, or other separate securement means.

The invention has been described with reference to a preferred embodiment. Obviously, modifications and alterations will occur to others upon reading and understanding the preceding specification. It is intended that the invention be construed as including all such modifications and alterations insofar as they are encompassed by the appended claims and equivalents.

Having thus described the preferred embodiments, what is claimed is:

1. A kit package comprising:

an inner package element defining: (i) a pedestal base having a support surface adapted for supporting an associated primary kit component, an open hollow region beneath said support surface adapted for receipt of a package of loose kit components, and a secondary component receiving region adapted for receipt of an associated secondary kit component defined in a sidewall of said pedestal base that is connected to said support surface; and, (ii) a transparent secondary component securement flap connected to said pedestal base and movable into a folded position adjacent said pedestal base, said flap at least partially enclosing said secondary component receiving region; and, a transparent plastic outer package element defining a hollow compartment adapted for receipt of the inner package element.

2. The kit package as set forth in claim 1, wherein said outer package element comprises:

a first portion that defines said hollow compartment; and, a second portion that mates with said first portion and encloses said hollow compartment.

3. The kit package as set forth in claim 1, wherein said outer package element comprises:

at least first and second portions that are adapted for connection and that together define said hollow compartment when connected together.

4. The kit package as set forth in claim 1, wherein said secondary component securement flap defines a distal end that projects outwardly beyond said pedestal support surface when said flap is located in said folded position, said distal end defining a recess adapted for close receipt of a portion of an associated primary kit component.

5. The kit package as set forth in claim 1, wherein said pedestal base comprises a plurality of sidewalls that depend from said support surface, and wherein at least two of said sidewalls define respective ones of said secondary component receiving region.

6. The kit package as set forth in claim 5, wherein said pedestal base defines said secondary component receiving regions in first and second sidewalls located on opposite ends of said pedestal base, and wherein said inner package element comprises first and second secondary component securement flaps connected to and adapted for movement into a folded position adjacent said first and second sidewalls, respectively.

7. The kit package as set forth in claim 6, wherein said first and second secondary component securement flaps are respectively connected to said first and second sidewalls by first and second living hinges.

8. The kit package as set forth in claim 7, wherein said first and second secondary component securement flaps each define a distal end that projects outwardly beyond said pedestal support surface.

9. A kit package comprising:

an inner package element defining: (i) a pedestal base having a support surface adapted for supporting an associated primary kit component and a plurality of sidewalls depending from said support surface, said plurality of sidewalls and said support surface defining a hollow region adapted for receipt of an associated package of loose components, wherein at least one of said sidewalls defines a region adapted for receipt of an associated secondary kit component; and, (ii) a secondary component securement flap connected to said pedestal base and movable into a folded position adjacent said pedestal base, said flap at least partially enclosing said secondary component receiving region; and, an outer package element defining a hollow compartment adapted for receipt of the inner package element.

10. The kit package as set forth in claim 9, wherein said inner and outer package elements are defined from a transparent plastic material.

11. A kit comprising:

an outer package defining a hollow interior compartment;

a pedestal member located in said interior compartment of said outer package, said pedestal member comprising a support surface and a plurality of sidewalls that depend from said support surface;

a primary kit component located on said support surface; and, a package of loose kit components located in a space defined between said plurality of sidewalls and said support surface of said pedestal member.

12. The kit as set forth in claim 11, wherein said outer package is at least partially transparent.

13. A kit comprising:

an outer package defining a hollow interior compartment;

a pedestal member defining a support surface located in said interior compartment, said pedestal comprising a plurality of sidewalls connected to said support surface;

a primary kit component located on said support surface;

a secondary kit component located in a secondary component receiving region defined in one of said plurality of sidewalls of said pedestal; and, at least one package of loose kit components located in a space defined between said plurality of sidewalls.

14. A kit comprising:

an outer package defining a hollow interior compartment;

a pedestal member located in said interior compartment, said pedestal member comprising a support surface and a sidewall connected to said support surface, said sidewall defining a secondary component receiving region;

a primary kit component located on said support surface;

a secondary kit component located in said secondary component receiving region; and, a movable flap connected to said sidewall of said pedestal and movable to a folded position adjacent said sidewall to capture said secondary kit component in said secondary component receiving region.

15. The kit as set forth in claim 14, where said flap defines a recess adapted to receive a portion of said primary kit component located on said support surface to inhibit movement of said primary kit component away from said support surface.

* * * * *